US006539586B2

(12) United States Patent
Pferdmenges et al.

(10) Patent No.: US 6,539,586 B2
(45) Date of Patent: Apr. 1, 2003

(54) TRASH REMOVAL ASSEMBLY IN A FIBER PROCESSING MACHINE

(75) Inventors: Gerd Pferdmenges, Jüchen (DE); Markus Schmitz, Mönchengladbach (DE)

(73) Assignee: Trutzschler GmbH & Co. KG (DE)

( * ) Notice: Subject to any disclaimer, the term of this patent is extended or adjusted under 35 U.S.C. 154(b) by 0 days.

(21) Appl. No.: 09/964,430

(22) Filed: Sep. 28, 2001

(65) Prior Publication Data

US 2002/0038494 A1 Apr. 4, 2002

(30) Foreign Application Priority Data

Sep. 30, 2000 (DE) ..... 100 48 664

(51) Int. Cl.[7] ..... D01G 15/76

(52) U.S. Cl. ..... 19/109; 19/98; 19/112; 19/200

(58) Field of Search ..... 19/98, 99, 101, 19/104, 105, 106 R, 107, 108, 109, 110, 112, 200, 202, 203, 204, 205

(56) References Cited

U.S. PATENT DOCUMENTS 4,539,728 A * 9/1985 Portell ..... 19/105
5,146,652 A * 9/1992 Leifeld ..... 19/204
5,255,415 A * 10/1993 Leifeld et al. ..... 19/107
5,313,688 A * 5/1994 Leifeld et al. ..... 19/107
5,333,358 A * 8/1994 Leifeld ..... 19/105
5,546,635 A * 8/1996 Leifeld ..... 19/200
5,613,278 A * 3/1997 Temburg ..... 19/105
5,737,806 A * 4/1998 Leifeld et al. ..... 19/98
5,862,573 A * 1/1999 Leifeld ..... 19/105

FOREIGN PATENT DOCUMENTS

| | | |
|---|---|---|
| DE | 34 08 350 | 9/1985 |
| DE | 44 39 564 | 5/1996 |
| GB | 2 228 018 | 8/1990 |
| GB | 2 249 324 | 5/1992 |

* cited by examiner

*Primary Examiner*—Gary L. Welch
(74) *Attorney, Agent, or Firm*—Venable; Robert Kinberg

(57) ABSTRACT

A fiber processing machine includes a first roll having a circumferential surface carrying a first clothing; a second roll having a circumferential surface carrying a second clothing and adjoining the first roll for taking over fiber material carried by the first roll as the first and second rolls rotate; a nip defined between the first and second clothings at a location where the first and second clothings are closest to one another; a bight defined by a generally triangular area immediately adjoining the nip and bounded by an end thereof and by circumferential length portions of the first and second clothings extending away from the nip end; and a cutting edge positioned in the bight and cooperating with one of the rolls for separating impurities from the fiber material as the fiber material is carried past the cutting edge by the roll clothing.

16 Claims, 5 Drawing Sheets

TRASH REMOVAL ASSEMBLY IN A FIBER PROCESSING MACHINE

CROSS REFERENCE TO RELATED APPLICATION

This application claims the priority of German Application No. 100 48 664.9 filed Sep. 30, 2000, which is incorporated herein by reference.

BACKGROUND OF THE INVENTION

This invention relates to a trash removal assembly in a fiber processing machine such as a carding machine, a cleaner or the like, particularly for processing cotton fiber. The fiber processing machine is of the type which includes at least two consecutive clothed rolls arranged downstream of a fiber feeding assembly, as viewed in the direction of fiber advance. The clothing may consist of saw teeth, needles or pins. At least one of the clothed rolls is associated with a cutting (severing) edge, for example, of a mote knife, oriented opposite the direction of roll rotation for removing trash or other waste from the fiber material. The mote knife is associated with a waste outlet opening. To expose the fiber material to a draft, the circumferential speed of a downstream arranged a clothed roll is greater than that of an upstream clothed roll. Viewing two consecutive clothed rolls, the downstream clothed roll cooperates with the upstream clothed roll as a takeover and opening roll.

In a known multi-roll cleaner with each clothed roll a mote knife is associated which cooperates with a cover element which shrouds one part of the same roll. The fiber material removed from the upstream roll and entrained by the downstream roll advances in a closed space through the cover in the direction of roll rotation. The cover element extends in a direction against the direction of rotation into the upstream bight, fully occupying that space. Between the mote knife and the open end of the cover element a waste outlet opening for impurities (trash) is provided. Material passing through the waste outlet opening is carried away by a suction stream passing through a hood.

SUMMARY OF THE INVENTION

It is an object of the invention to provide an improved waste removal assembly of the above-outlined type in a carding machine, a cleaner or the like.

This object and others to become apparent as the specification progresses, are accomplished by the invention, according to which, briefly stated, the fiber processing machine includes a first roll having a circumferential surface carrying a first clothing; a second roll having a circumferential surface carrying a second clothing and adjoining the first roll for taking over fiber material carried by the first roll as the first and second rolls rotate; a nip defined between the first and second clothings at a location where the first and second clothings are closest to one another; a bight defined by a generally triangular area immediately adjoining the nip and bounded by an end thereof and by circumferential length portions of the first and second clothings extending away from the nip end; and a cutting edge positioned in the bight and cooperating with one of the rolls for separating impurities from the fiber material as the fiber material is carried past the cutting edge by the roll clothing.

By virtue of the arrangement of the mote knife according to the invention, a separation of trash or other impurities from the fiber material is possible in the region where fiber opening takes place. By virtue of the fact that the circumferential speed of a consecutive roll is greater than that of a preceding roll, the fiber material is exposed to a draft as it passes from one roll to the other. In such an arrangement all fibers shift relative to one another and thus the fiber is opened. The impurities in the fiber material too, move and reorient themselves in the drafted, and thus loosened, fiber mass. Further, the fiber material, as it passes from one roll to the successive roll, assumes an arcuate course which is opposite to that on the preceding roll. At that location, particularly between the location of separation from the upstream roll and the transfer location on the downstream roll in which the fiber material proceeds freely between the clothing of the two rolls so that it may undergo drafting, the impurities are effectively separated from the fiber material by the mote knife and are guided away from the clothed rolls.

BRIEF DESCRIPTION OF THE DRAWING

FIG. 5 is a fragmentary schematic side elevational view of a licker-in and further illustrating a mote knife and its angular orientation to, and its distance from, the licker-in.

DESCRIPTION OF THE PREFERRED EMBODIMENTS

Figure 1:
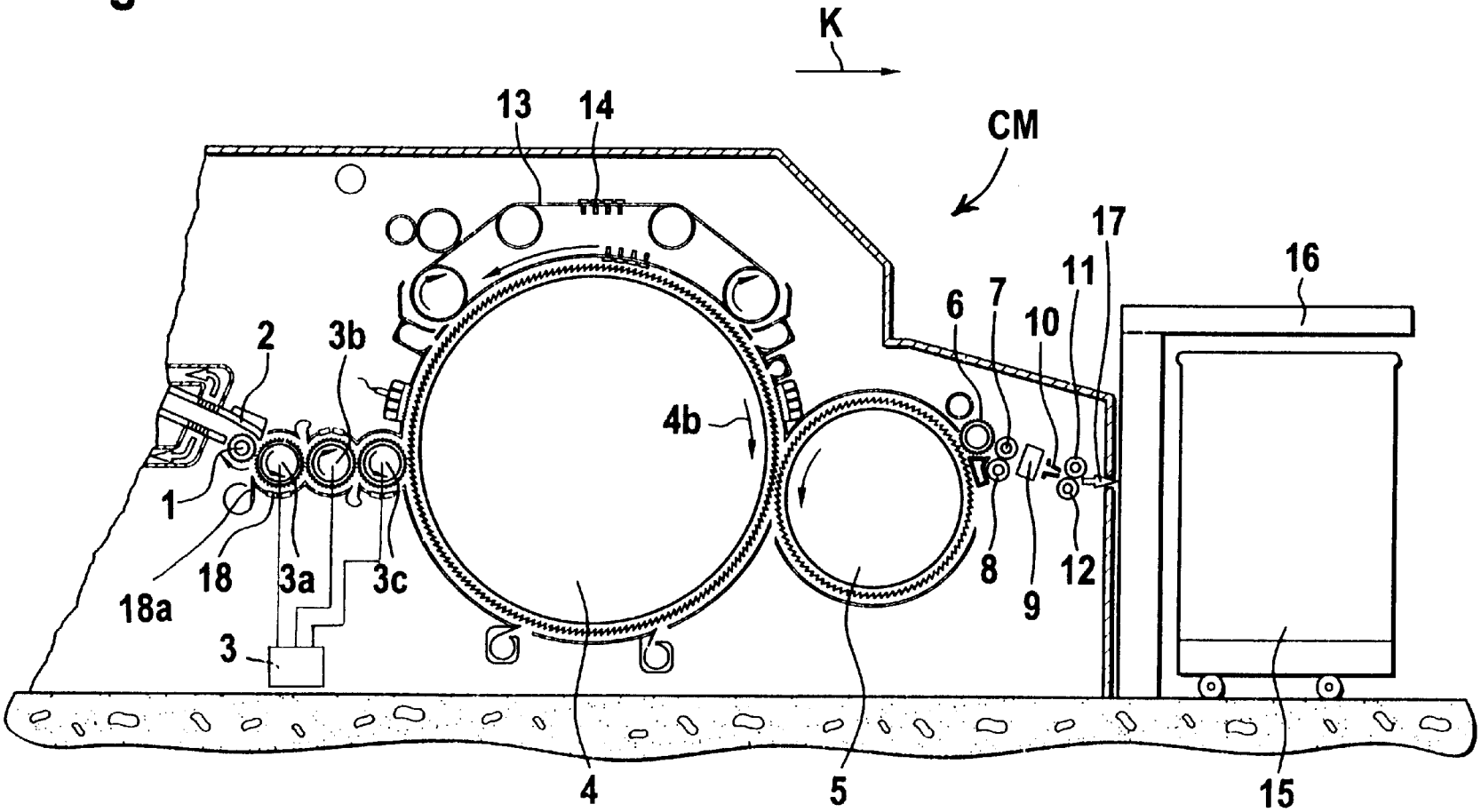
FIG. 1 is a schematic side elevational view of a carding machine incorporating the invention.

FIG. 1 shows a carding machine CM which may be, for example, a DK 903 model, high-performance carding machine manufactured by Trützschler GmbH & Co. KG, M önchengladbach, Germany. The carding machine CM has, for introducing the fiber material G, a feed roll 1, a feed table 2 cooperating therewith, licker-ins 3*a*, 3*b*, 3*c*, a main carding cylinder 4, a doffer 5, a stripping roll 6, crushing rolls 7, 8, a web-guiding element 9, a sliver trumpet 10, calender rolls 11, 12 and a traveling flats assembly 13 having slowly circulating flat bars 14. The direction of rotation of the rolls of the carding machine is shown by respective arrows. At the output of the carding machine a sliver coiler 16 is disposed which deposits sliver into a coiler can 15. The advancing direction (working direction) of the fiber material is designated at K.

Figure 2:
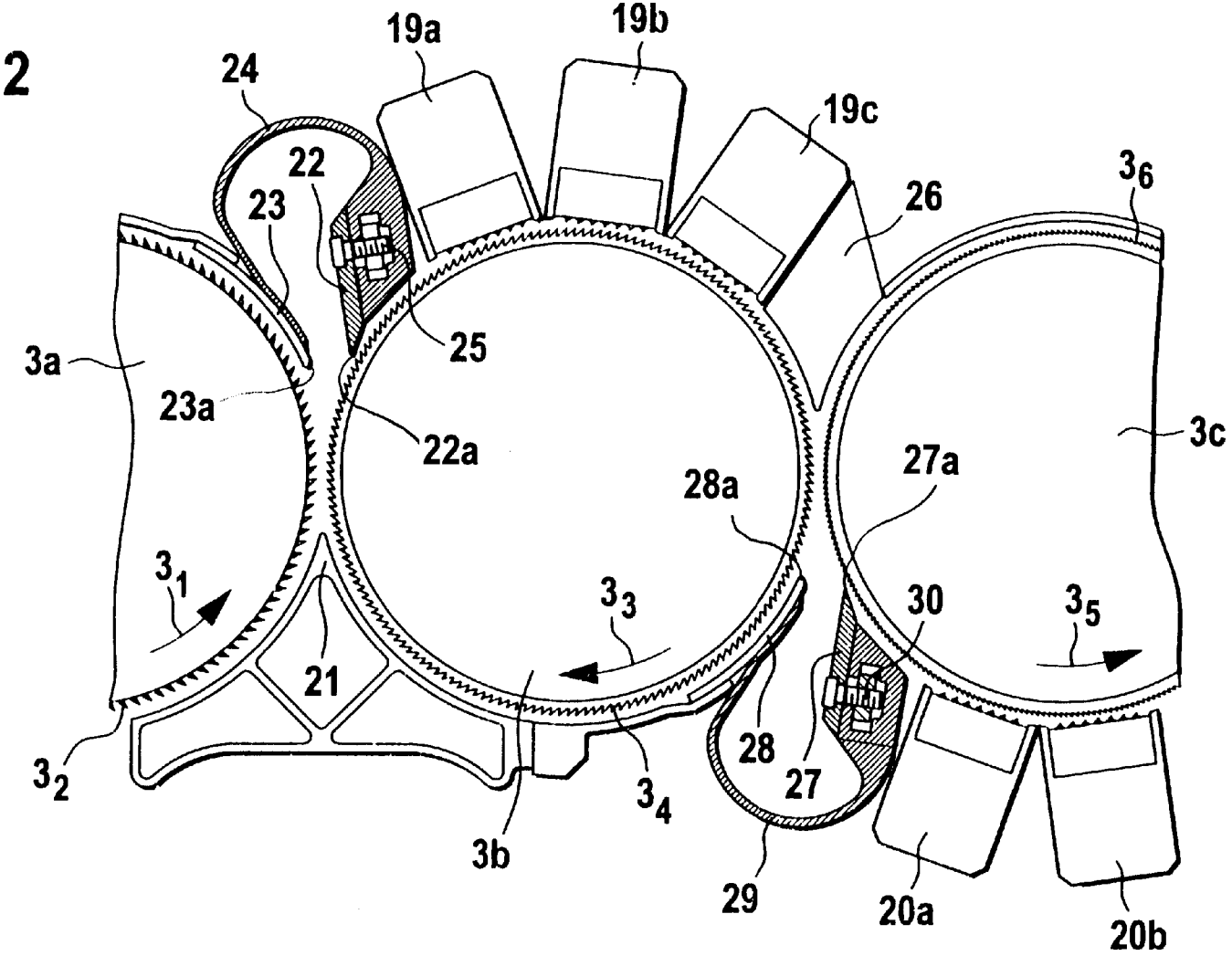
FIG. 2 is an enlarged detail of FIG. 1, showing a preferred embodiment of the invention.

Also referring to FIG. 2, the fiber material to be carded is, as a fiber batt, advanced from a non-illustrated device to the feeding arrangement of the carding machine, composed of the feed roll 1 and the feed table 2. The fiber batt is held firmly between the feed roll 1 and the feed table 2 and as the feed roll 1 is rotated clockwise, the material is slowly advanced in the direction of the licker-in 3*a*. The pins $\mathbf{3}_2$ of the licker-in 3*a* penetrate into the advancing fiber batt and loosen fibers therefrom which are further transported by the needles $\mathbf{3}_2$. The licker-in 3*a* rotates significantly faster than the feed roll 1 and its direction of rotation is opposite to that of the feed roll 1. The loosened fibers pass by a waste outlet opening where a severing edge of a mote knife 18*a* removes impurities which are transported away by means of a suction device. Thereafter, the fibers pass through a stationary carding element 18 before they reach the successive, clockwise-rotating licker-in 3*b* which has a sawtooth clothing $\mathbf{3}_4$. From the rotating licker-in 3*b* the fibers are transferred to the counterclockwise-rotating licker-in 3*c* which is provided with a sawtooth clothing $\mathbf{3}_6$; the teeth are finer than those carried by the licker-in 3*b*. From the licker-in 3*c* the fibers are transferred to the main carding cylinder 4 of the carding machine CM. All licker-ins 3*a*, 3*b* and 3*c* are provided with a cover. A drive 3 rotates the licker-in 3*b* faster than the licker-in 3*a* and rotates the licker-in 3*c* faster than the licker-in 3*b*.

Particularly referring to FIG. 2, between the licker-ins 3*a* and 3*b* an upper, diverging bight and a lower, converging bight are formed. The bights have a generally triangular area and extend from both ends of the nip (the closest distance between the clothing $\mathbf{3}_2$ and the clothing $\mathbf{3}_4$) between circumferential length portions of the clothings $\mathbf{3}_2$ and $\mathbf{3}_4$. In the lower, converging bight of the licker-ins 3*a* and 3*b*, that is, in the bight which closes as the licker-ins 3*a* and 3*b* rotate in the direction $\mathbf{3}_1$ and $\mathbf{3}_3$ toward the nip, respectively, a cover element 21 is provided which substantially fills and thus closes the area of the converging bight. The cover element 21 may be, for example, an extruded member. In the upper, diverging bight, that is, in the bight which opens as the licker-ins 3*a* and 3*b* rotate in the direction $\mathbf{3}_1$ and $\mathbf{3}_3$ away from the nip, respectively, a mote knife 22 is positioned whose severing edge 22*a* is oriented against the rotary direction $\mathbf{3}_3$ of the licker-in 3*b* and is spaced from the clothing $\mathbf{3}_4$ at a distance a (shown in FIG. 5) adjustable by a setscrew 25. Also, in the diverging bight between the licker-ins 3*a* and 3*b* a curved cover element 23 is provided which has a free end 23*a*. The cover element 23 covers one part of the licker-in 3*a*. The cover element 23 is, in a manner not illustrated, shiftable concentrically to the cylindrical outer face of the licker-in 3*a*. It also can be pivoted towards or away from the licker-in 3*a* about a point of rotation. The edge 22*a* of the mote knife 22 and the free end 23*a* of the cover element 23 define a waste outlet (separating) opening which constitutes the inlet of a hood 24 for removing trash, dust, short fibers and the like separated from the fiber material.

Similarly, between the licker-ins 3*b* and 3*c* two bights are formed. As shown in FIG. 2, in the converging bight a cover element 26 is arranged, such as an extruded profile member which fully occupies and thus closes the bight. In the diverging bight a mote knife 27 is disposed whose severing edge 27*a* is oriented opposite the rotary direction $\mathbf{3}_5$ of the licker-in 3*c* and is spaced at a distance a (shown in FIG. 5) from the clothing $\mathbf{3}_6$. The distance a may be adjusted by a setscrew 30. Also, in the diverging bight between the licker-ins 3*b* and 3*c* a curved cover element 28 is provided which has a free end 28*a*. The cover element 28 covers one part of the licker-in 3*b*. The cover element 28 is, in a manner not illustrated, shiftable concentrically to the cylindrical outer face of the licker-in 3*b*, as indicated by the double-headed arrow F. It also can be pivoted towards or away from the licker-in 3*b* about a point of rotation. The edge 27*a* of the mote knife 27 and the free end 28*a* of the cover element 28 define a waste outlet (separating) opening which constitutes the inlet of a hood 29 for removing trash, dust, short fibers and the like separated from the fiber material.

Three stationary carding elements 19*a*, 19*b*, 19*c* and two stationary carding elements 20*a*, 20*b* cooperate with respective licker-ins 3*b* and 3*c*. The stationary carding elements are associated in each instance with the upstream-arranged mote knife as viewed in the rotary direction of the respective rolls.

Figure 3:
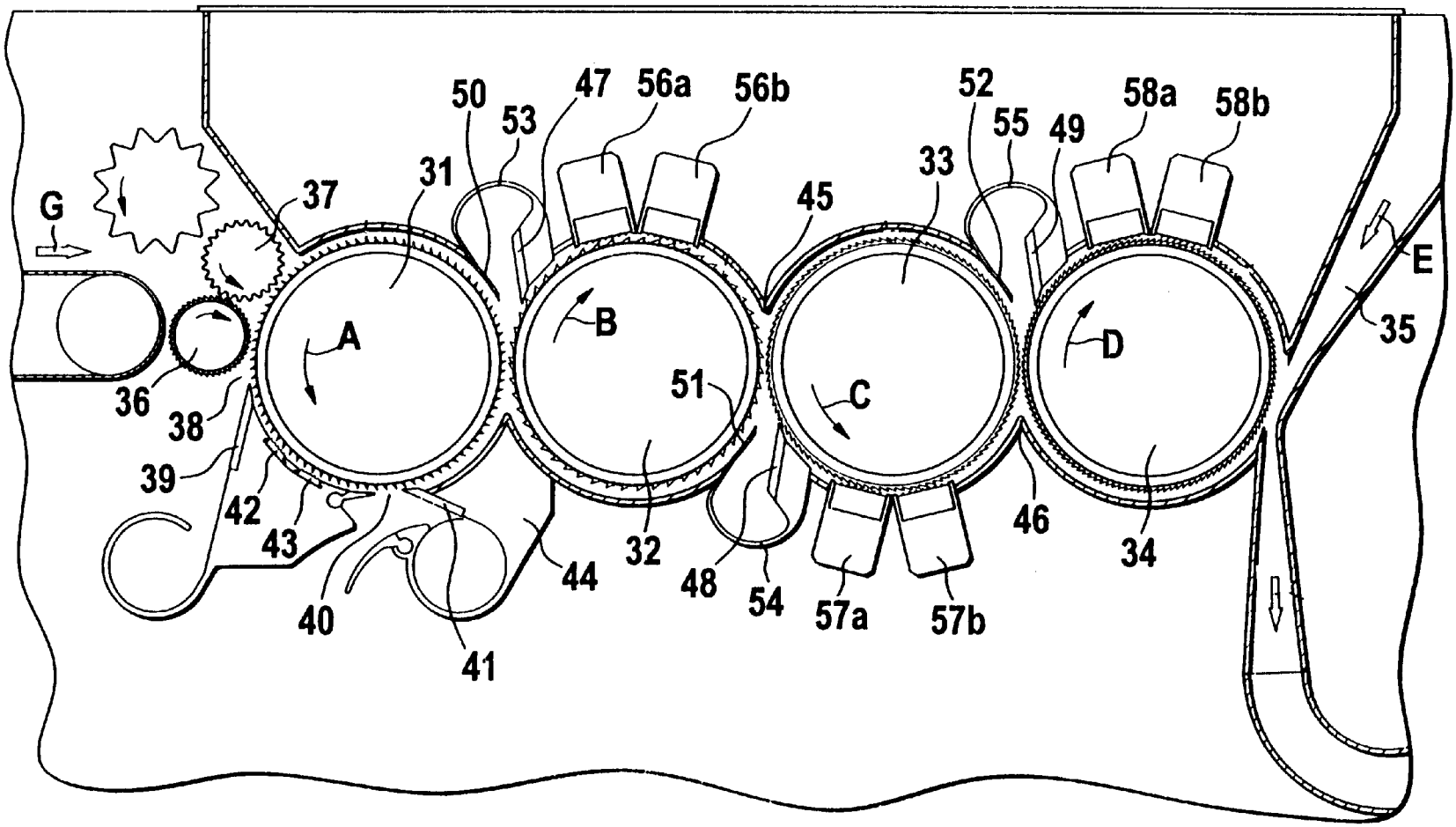
FIG. 3 is a schematic side elevational view of a preferred embodiment of the invention incorporated in a multi-roll fiber cleaner.

Turning to FIG. 3, four rolls 31, 32, 33 and 34 of a fiber cleaning apparatus are consecutively arranged; their rotary direction is designated at A, B, C and D, respectively. At the end of the roll 34 a pneumatic suction device 35 is disposed for entraining the fiber material by an air stream E. The rolls 31–34 have the same diameter and the circumferential speed of each roll is greater than the upstream preceding roll.

The fiber material to be cleaned, particularly cotton, is advanced as fiber tufts to the cleaning apparatus accommodated in a closed housing. Such material advance is effected, for example, by means of a non-illustrated feed chute, a supply belt or the like. The fiber tuft mass (fiber batt) is admitted to the roll 31 (having a pin clothing) by means of two feed rolls 36, 37 which clamp the fiber batt. The roll 31 may have a diameter of 150–300 mm (for example, 250 mm). The roll 31 is followed by the roll 32 (having a sawtooth clothing). The circumferential speed of the roll 31 may be approximately 10–21 m/sec, for example, 15 m/sec, whereas the roll 32 may have a circumferential speed of, for example, 15–25 m/sec; the roll 33 may have a circumferential speed of about 30–35 m/sec, for example, 32 m/sec; and the roll 34 may have a circumferential speed of 40–50 m/sec, for example, 46 m/sec.

A waste outlet opening 38 is associated with the roll 31 for discharging impurities. The size of the opening 38 may be adjusted to adapt it to the degree of impurity of the cotton to be treated. The waste outlet opening 38 is bordered by a mote knife 39. In the rotary direction A of the roll 31 a further waste outlet opening 40 and a mote knife 41 associated therewith are arranged. stationary carding elements 42 and 43 are cooperating with the clothing of the roll 31 between the openings 38 and 40.

Cover elements 44, 45, 46 are disposed in the respective converging bights formed between rolls 31,32; 32,33; and 33, 34. Further, mote knives 47, 48, 49 are disposed in the respective diverging bights formed between rolls 31,32; 32,33; and 33, 34.

Cover elements 50, 51 and 52 are associated with the respective rolls 31, 32 and 33 and face the respective mote knives 47, 48 and 49. Suction devices 53, 54, 55 are coupled to the respective mote knife 47 and the cover element 50; the mote knife 48 and the cover element 51; and the mote knife 49 and the cover element 52.

Pairs of stationary carding elements 56*a*, 56*b*; 57*a*, 57*b*; and 58*a*, 58*b* cooperate with rolls 32, 33 and 34, respectively.

Figure 4:
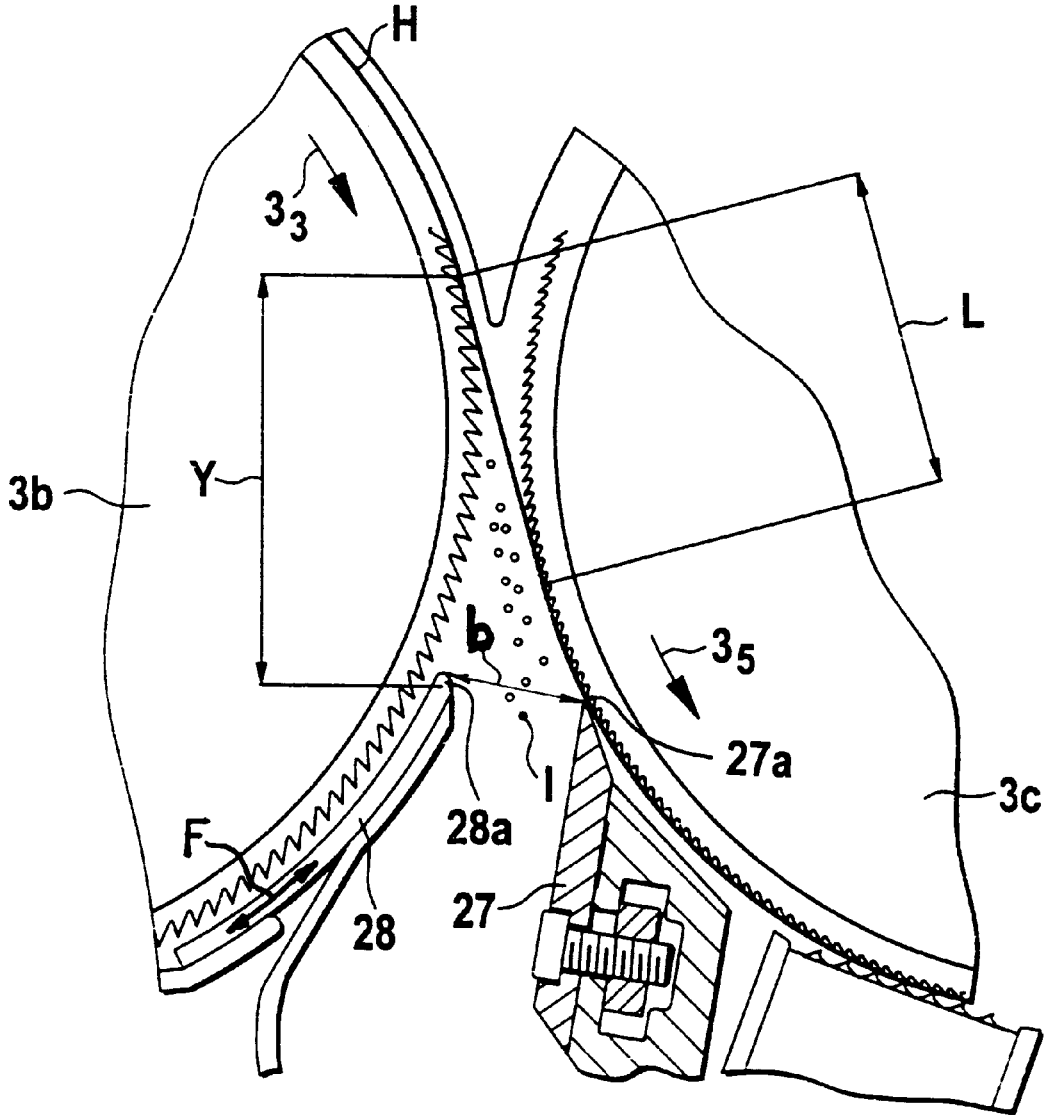
FIG. 4 is an enlarged detail of FIG. 2 showing two adjoining clothed rolls illustrating the transition and drafting of the fiber material between the two rolls.

FIG. 4 illustrates the construction and structural relationships of the region between any two adjoining rolls, in the example between rolls (licker-ins) 3*b* and 3*c* of the carding machine CM of FIG. 1. The same features are present between rolls 3*a* and 3*b* as well as between any adjoining rolls 31–34 in the fiber cleaning apparatus of FIG. 3.

Thus, as shown in FIG. 4, between the severing edge 27*a* of the mote knife 27 and the open end 28*a* of the cover element 28 a clearance b is provided through which trash I separated from the fiber material H passes and is removed by suction. The clearance b extends far into the diverging bight defined between rolls 3*b* and 3*c*. Between the clearance b and the nip between the rolls 3*b* and 3*c* no structural elements are provided. In that space the fiber material H passes from the 3*b* to the roll 3*c*.

In the description which follows, the operation of the construction shown in FIG. 3 will be described.

The fiber tuft batt is admitted from the feed rolls 36, 37, under a clamping effect, to the roll 31 which combs through the fiber material and entrains fiber staples on its clothing.

As the material passes by the waste outlet opening 38, dependent upon the circumferential speed and curvature of the roll as well as the size of the opening 38 adapted to this first separating stage, short fibers and coarse impurities are hurled away by centrifugal forces from the fiber material which, after passing through the opening 38, are introduced into a trash chamber in the housing. The fiber material, preliminarily cleaned in this manner, is taken over from the roll 31 by the clothing of the roll 32, whereby a further opening of the material takes place. As the material on the roll 32 passes by the mote knife 47, further impurities are thrown out from the fiber material by centrifugal forces. The fiber material carried by the roll 34 is stripped therefrom by an air stream E traveling in a conduit 35 which is oriented generally tangentially to the roll 34.

Reverting to FIG. 4, the fiber material H, as it passes from the rotating licker-in 3*b* to the more rapidly rotating licker-in 3*c*, is exposed to a draft in the region L which designates a first opening distance. This distance which is adjustable, corresponds essentially to the distance between the location of removal of the fiber material H from the licker-in 3*b* and the location of take-over of the fiber material H on the licker-in 3*c*. The distance between the location of removal of the fiber material H from the licker-in 3*b* and the open end 28*a* of the cover element 28 is designated at Y and represents a second opening distance which is also adjustable.

Figure 5:
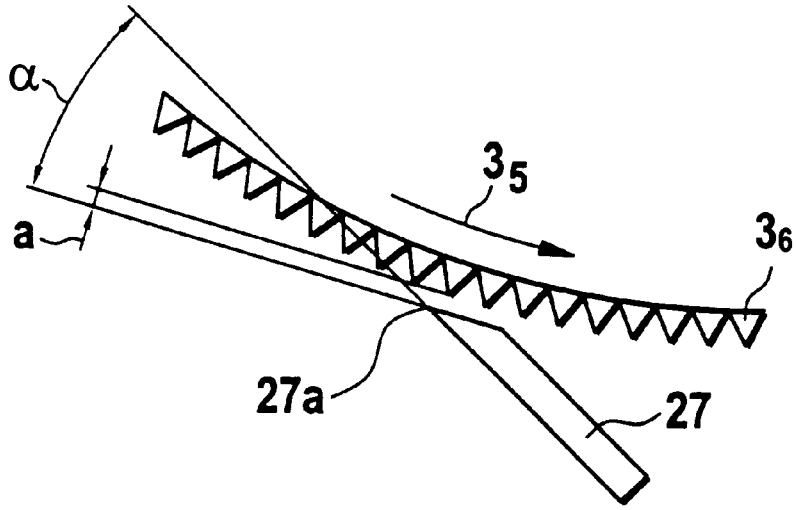

FIG. 5 shows that the mote knife 27 is oriented against the rotary direction $\mathbf{3}_5$ and forms an angle $\alpha$ with the tangent drawn to the clothing $\mathbf{3}_6$. The knife edge 27*a* is at a distance a from the clothing $\mathbf{3}_6$.

Figure 6:
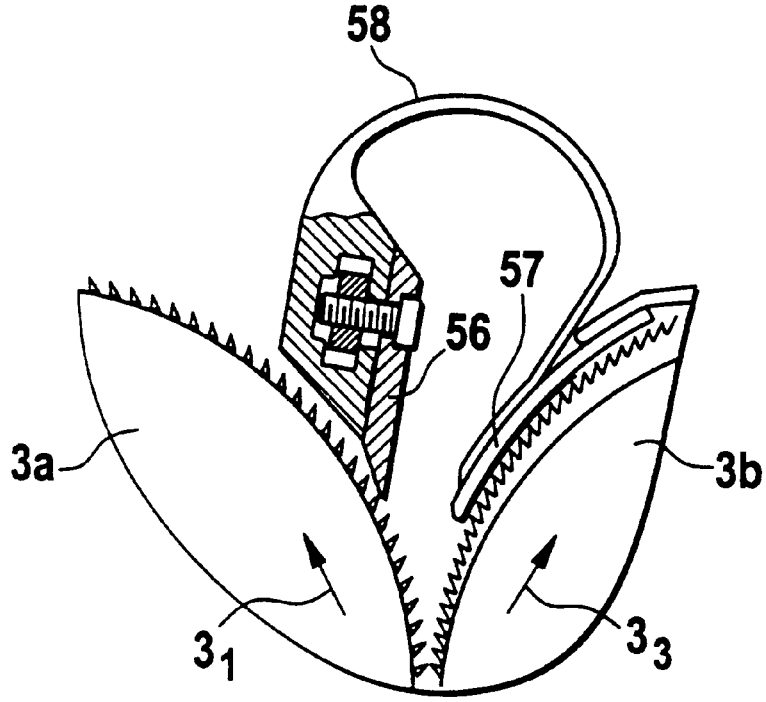
FIG. 6 is a fragmentary schematic side elevational view of two adjoining clothed rolls and a trash-removal assembly disposed therebetween.

FIG. 6 shows a mote knife 56 and a cover element 57 disposed in the diverging bight defined between the licker-ins 3*a* and 3*b* connected by a suction hood 58.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) a first roll having a circumferential surface carrying a first clothing;

(b) a second roll having a circumferential surface carrying a second clothing and adjoining said first roll for taking over fiber material carried by said first roll as said first and second rolls rotate;

(c) a nip defined between said first and second clothings at a location where said first and second clothings are closest to one another;

(d) a bight defined by a generally triangular area immediately adjoining said nip and bounded by an end of said nip and by circumferential length portions of said first and second clothings extending away from said nip from said end thereof;

(e) a cutting edge positioned in said bight and cooperating with one of said first and second rolls for separating impurities from the fiber material as the fiber material is carried past said cutting edge by the clothing of said one roll;

(f) means for driving said first and second rolls in opposite directions; and (g) a component terminus defining with said cutting edge a clearance constituting a waste removal opening through which impurities separated from the material pass.

2. The fiber processing machine as defined in claim 1, wherein said cutting edge cooperates with said second roll.

3. The fiber processing machine as defined in claim 1, wherein said cutting edge is oriented tangentially to said other of said first and second rolls.

4. The fiber processing machine as defined in claim 1, wherein said cutting edge is oriented obliquely to said other of said first and second rolls.

5. The fiber processing machine as defined in claim 1, wherein said fiber processing machine is a cleaner including a plurality of cleaning rolls arranged in a series; said first and second rolls constituting two of said cleaning rolls.

6. The fiber processing machine as defined in claim 1, wherein said fiber processing machine is a carding machine including a plurality of licker-in rolls arranged in a series; said first and second rolls constituting two of said licker-in rolls.

7. The fiber processing machine as defined in claim 1, further comprising a plurality of stationary carding elements cooperating with said first and said second clothings.

8. A fiber processing machine comprising (a) a first roll having a circumferential surface carrying a first clothing;

(b) a second roll having a circumferential surface carrying a second clothing and adjoining said first roll for taking over fiber material carried by said first roll as said first and second rolls rotate;

(c) a nip defined between said first and second clothings at a location where said first and second clothings are closest to one another;

(d) a bight defined by a generally triangular area immediately adjoining said nip and bounded by an end of said nip and by circumferential length portions of said first and second clothings extending away from said nip from said end thereof;

(e) a cutting edge positioned in said bight and cooperating with one of said first and second rolls for separating impurities from the fiber material as the fiber material is carried past said cutting edge by the clothing of said one roll; and (f) drive means for rotating said second roll at a greater circumferential speed than said first roll for exposing the fiber material to a draft between said first and second rolls.

9. A fiber processing machine comprising (a) a first roll having a circumferential surface carrying a first clothing;

(b) a second roll having a circumferential surface carrying a second clothing and adjoining said first roll for taking over fiber material carried by said first roll as said first and second rolls rotate;

(c) a nip defined between said first and second clothings at a location where said first and second clothings are closest to one another;

(d) a bight defined by a generally triangular area immediately adjoining said nip and bounded by an end of said nip and by circumferential length portions of said first and second clothings extending away from said nip from said end thereof; and (e) a mote knife having a cutting edge positioned in said bight and cooperating with one of said first and second rolls for separating impurities from the fiber material as the fiber material is carried past said cutting edge by the clothing of said one roll.

10. A fiber processing machine comprising (a) a first roll having a circumferential surface carrying a first clothing;

(b) a second roll having a circumferential surface carrying a second clothing and adjoining said first roll for taking over fiber material carried by said first roll as said first and second rolls rotate;

(c) a nip defined between said first and second clothings at a location where said first and second clothings are closest to one another;

(d) a bight defined by a generally triangular area immediately adjoining said nip and bounded by an end of said nip and by circumferential length portions of said first and second clothings extending away from said nip from said end thereof;

(e) a cutting edge positioned in said bight and cooperating with one of said first and second rolls for separating impurities from the fiber material as the fiber material is carried past said cutting edge by the clothing of said one roll; and (f) a cover element extending into said bight; said cover element at least partially covering the other of said first and second rolls; said cover element having a terminus defining with said cutting edge a clearance constituting a waste removal opening through which impurities separated from the material pass.

11. The fiber processing machine as defined in claim 10, wherein said cover element is curved.

12. The fiber processing machine as defined in claim 10, wherein said cover element is circumferentially adjustable parallel to an outer surface of said other of said first and second rolls.

13. The fiber processing machine as defined in claim 10, further comprising a third roll preceding said first roll; said cover element covering at least partially said first and said third rolls.

14. The fiber processing machine as defined in claim 10, further comprising setting means for adjusting a distance of said cutting edge from the clothing of said one of said first and second rolls.

15. A fiber processing machine comprising (a) a first roll having a circumferential surface carrying a first clothing;

(b) a second roll having a circumferential surface carrying a second clothing and adjoining said first roll for taking over fiber material carried by said first roll as said first and second rolls rotate;

(c) a nip defined between said first and second clothings at a location where said first and second clothings are closest to one another;

(d) a bight defined by a generally triangular area immediately adjoining said nip and bounded by an end of said nip and by circumferential length portions of said first and second clothings extending away from said nip from said end thereof;

(e) a cutting edge positioned in said bight and cooperating with one of said first and second rolls for separating impurities from the fiber material as the fiber material is carried past said cutting edge by the clothing of said one roll; and (f) means for driving said first and second rolls in opposite directions; said circumferential length portions of said first and second clothings moving away from said end of said nip, whereby said bight is a diverging bight.

16. A fiber processing machine comprising (a) a first roll having a circumferential surface carrying a first clothing;

(b) a second roll having a circumferential surface carrying a second clothing and adjoining said first roll for taking over fiber material carried by said first roll as said first and second rolls rotate;

(c) a nip defined between said first and second clothings at a location where said first and second clothings are closest to one another;

(d) a bight defined by a generally triangular area immediately adjoining said nip and bounded by an end of said nip and by circumferential length portions of said first and second clothings extending away from said nip from said end thereof;

(e) a cutting edge positioned in said bight and cooperating with one of said first and second rolls for separating impurities from the fiber material as the fiber material is carried past said cutting edge by the clothing of said one roll; and (f) a suction hood for carrying away by a vacuum stream impurities separated from the fiber material at said cutting edge; said bight being enclosed in said suction hood.

* * * * *